United States Patent [19]

Mitsuishi

[11] 4,375,338

[45] Mar. 1, 1983

[54] WIRE DOT PRINT HEAD

[75] Inventor: Akio Mitsuishi, Shiojiri, Japan

[73] Assignees: Kabushiki Kaisha Suwa Seikosha, Tokyo; Shinshu Seiki Kabushiki Kaisha, Nagano, both of Japan

[21] Appl. No.: 169,069

[22] Filed: Jul. 15, 1980

[30] Foreign Application Priority Data

Jul. 16, 1979 [JP] Japan ..... 54-98501[U]
Jul. 17, 1979 [JP] Japan ..... 54-90736

[51] Int. Cl.[3] ..... B41J 3/12
[52] U.S. Cl. ..... 400/124; 101/93.05
[58] Field of Search ..... 400/124; 101/93.05

[56] References Cited

U.S. PATENT DOCUMENTS 4,204,778 5/1980 Miyazawa et al. ..... 400/124

FOREIGN PATENT DOCUMENTS 2707189 1/1978 Fed. Rep. of Germany ..... 400/124

*Primary Examiner*—Paul T. Sewell

*Attorney, Agent, or Firm*—Blum, Kaplan, Friedman, Silberman & Beran

[57] ABSTRACT

An improved wire dot print head assembly for a wire dot printer including a resilient securing spring for holding the assembly elements secure is provided. The print head assembly includes a plurality of print wires, each selectively driven through a print nose by a plurality of electromagnets disposed about the print wires. A pivotable operating member engaged to the input end of the wire is actuated by an electromagnet with the fulcrum end of the operating member secured by a holding member. The holding member, nose, electromagnet and operating member are compressively retained by the resilient securing spring. The holding member is formed with a projection extending through the fulcum portion of the operating member to minimize magnetic reluctance of the magnetic flux by minimizing an air gap between a plunger mounted on the operating member and a yoke plate. The print head constructed in accordance with the invention permits improved dimensional accuracy in a simplified construction.

8 Claims, 6 Drawing Figures

WIRE DOT PRINT HEAD

BACKGROUND OF THE INVENTION

This invention relates generally to a wire dot print head and more particularly to a wire dot print head including a resilient securing spring for securing the print head elements and wherein the holding member is formed with a projection which extends through the fulcrum end of the operating member.

The operating elements of conventional wire dot print head assemblies are generally secured by screw connections. Such a manner of assembly presents several disadvantages. Firstly, there is significant work in tightening the screws, which adds substantially to the cost of assembly and presents additional work for tapping the holes for receiving the screws. Secondly, the nose on a wire dot print head is often formed from a plastic material and screw connections into tapered holes are likely to become loose due to creep of the plastic material of the nose. Examples of such screw connections are shown in U.S. Pat. Nos. 4,060,161 and No. 4,165,940, and a threaded magnet core for securing the electromagnet to a baseplate is shown in U.S. Pat. No. 3,929,214.

Wire dot printers are in great demand and are more advantageous than many other types of printers. This demand is due to the fact that the print heads are inexpensive to produce, are smaller in size and provide significantly greater ease of simultaneous copying. Specifically, there is today an increasing demand for smaller and less-expensive printers. Accordingly, it is desirable to provide a smaller and less-expensive wire dot print head, as the wire dot print head controls the greatest portion of the overall performance of a printer.

SUMMARY OF THE INVENTION

Generally speaking, in accordance with the invention, an improved wire dot print head is provided. The wire dot print head includes a plurality of dot wires supported in the print head and extending through a central print nose which includes wire guide members. A plurality of electromagnetic members for selectively driving the wires are disposed circumferentially about the central region of the nose, and a pivotable operating member is selectively actuated by the electromagnetic members for driving the wires from an at-rest position to a print position. A holding member bears on the fulcrum portion of the operating member when the operating member is selectively rotated during a print cycle. The nose, electromagnetic members, operating members and holding member are compressively retained in position by a securing member formed from a resilient material. In a preferred embodiment of the invention, the securing member is a securing spring having three arms projecting from a central position for engaging the nose at the operating end and extending to the forward end of the electromagnetic means for retaining the holding member and operating lever therebetween in the correct position.

In a further embodiment of the invention, the holding member is formed with a projection which extends through the fulcrum end of the operating member. The operating member is formed with an elongated guide opening for receiving the projection as the operating member rotates when a plunger thereon passes through an opening in the yoke during the print cycle. The projection on the fulcrum holding member engages a yoke mounted on the electromagnetic means for accurately positioning the yoke so that the plunger can pass therethrough with a minimum air gap between the magnetic plunger and the yoke for reducing the magnetic reluctance of the magnetic flux except in the area about the end surface of the plunger.

Accordingly, it is an object of the invention to provide an improved wire dot print head.

Another object of the invention is to provide an improved wire dot pint head including a resilient clamping member for securing the assembled elements of the print head.

A further object of the invention is to provide an improved wire dot print head including a fulcrum holding member formed with a projection for guiding and positioning the fulcrum portion of an operating lever.

Still a further object of the invention is to provide an improved wire dot print head wherein the holding member projection aligns the yoke for permitting a magnetic plunger to pass through an opening in the yoke.

Still another object of the invention is to provide an improved wire dot print head which is easily assembled.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
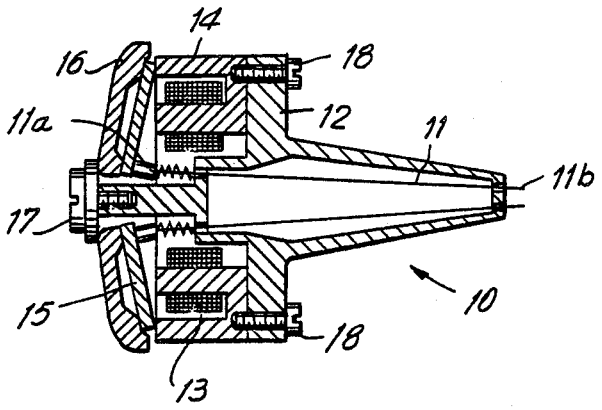
FIG. 1 PRIOR ART
FIG. 1 is a cross-sectional view of a wire dot print head assembled conventionally with screws.

Referring now to FIG. 1, the cross section of a conventional wire dot print head is shown generally as 10. Wire dot print head 10 includes a nose 12 for retaining a plurality of dot wires 11 having an input end **11*a* and the print end 11*b*. A driving core 14 includes a plurality of driving coils 13 disposed circumferentially about dot wires 11. A holding member 16 supports and guides a plurality of operating levers 15 corresponding in number to the number of dot wires 11. Nose 12 is secured to driving core 14 by a plurality of screws 18, and holding member 16 is secured to nose 12 by a central screw 17**.

The screw fasteners present a number of disadvantages. Specifically, assembly work is required to tighten each screw, thereby adding to the cost of assembly. Additional work is required for tapping the holes to receive screws 18 and 17, thereby further increasing the cost of assembly. Additionally, nose 12 is often fabricated from a plastic molded material, and screws fastened into a tapered hole often become loose due to creep of the plastic material. Such creep is precipitated by heat generated by driving coil 13 during operating of print head 10. Providing a wire dot print head in accordance with the invention eliminates the aforementioned drawbacks.

A wire dot print head constructed and arranged in accordance with the invention will now be described with reference to a preferred embodiment thereof shown in FIG. 2. The construction and operation of such a print head shown will be described.

One of a plurality of dot wires 201 is shown guided and supported by a wire guide 202*a*, an intermediate guide 203 and an end guide 204 mounted within a print head nose 202. A print end 201*a* of dot wire 201 faces a print paper 221 and an opposed input end thereof 201*b* includes a button portion 201*c* which is engaged with an operating end 206*a* of an operating lever 206. Dot wire 201 is urged against operating end 206*a* of operating lever 206 by a return spring 205 disposed between button portion 201*c* and nose 202 in the region of wire guide 202*a*. This is the at-rest position of dot wire 201.

The opposed end of operating lever 206 to operating end 206*a* is a fulcrum end 206*b*. A magnetic plunger 209 is mounted on operating lever 206 in the region of fulcrum end 206*b*. A driving coil 208 is mounted in a core frame 207 for defining a closed-loop magnetic circuit with plunger 209 and operating lever 206 and a yoke 210 mounted at the operating end of core frame 207.

A holding member 211 for securing operating lever 206 includes a leaf spring portion 211*a* which bears against and supports fulcrum end 206*b* of operating lever 206, which rotates about this position during a print cycle as will be described in more detail below. Operating end 206*a* of operating lever 206 engages button portion 201*c* of dot wire 201 and is supported on a stop portion 211*b* of holding member 211 for limiting the operating stroke of operating lever 206.

A radiating plate 212 is positioned on the printing side of core frame 207 for removing heat generated by driving coil 208 during the print cycle. A flexible base plate 213 is mounted adjacent to radiating plate 212 and core frame 207. A spacer or oil-holding sheet 214 is mounted between yoke 210 and fulcrum end 206*b* of operating lever 206 for preventing unnecessary wear. In accordance with this embodiment of the invention, a securing spring 215 secures the aforementioned operating components together to core frame 207.

During the printing operation, an electric current is supplied by a print control circuit (not shown) to driving coil 25 for an appropriate length of time for selectively activating the operating levers. When activated, operating lever 206 causes dot wire 201 to fly from its at-rest position to a print position toward paper 221. A flying dot wire 201 compresses an ink ribbon 220 and print paper 221 into striking contact with a platen 222 positioned at the print end of dot wire 201*a* for forming a printed dot on print paper 221. After striking against platen 222, dot wire 201 is returned to its standby position by return spring 205, thereby completing a cycle of the printing operation.

Securing spring 208 constructed and arranged in accordance with this embodiment of the invention will now be described in detail with reference to FIGS. 2 and 3. Securing spring 215 includes a central portion 215*d* having a central opening 215*a* for engaging a projection 202*b* formed on nose 202. Securing spring 215 is formed with three equidistantly spaced arms 215*c* extending from central portion 215*d* for engaging and retaining the print elements as follows. Arms 215*c* of securing spring 215 have a free position illustrated as 215' in FIG. 2. After the operating components of print head 200 are assembled and projection 202*b* is engaged in central opening 215*a*, free ends 215*b* of the three leaf spring arm portions 215*e* are urged from their free positions 215' in the direction of an arrow A into cooperating engagement recesses 202*c* formed in nose 202. When free ends 215*b* are engaged in recesses 202*c*, arms 215*c* are flexed a displacement to the extent shown at $\gamma$, and securing spring 215 develops a clamping force acting in the direction of an arrow B toward the rear or input end of print head 200. In accordance with this construction, even if nose 202 and operating lever holding member 211 are formed of a plastic material and exhibit some creep, securing spring 215, which is formed of an elastic material, maintains sufficient clamping force to prevent loosening and misalignment of the parts during printing.

Figure 3:
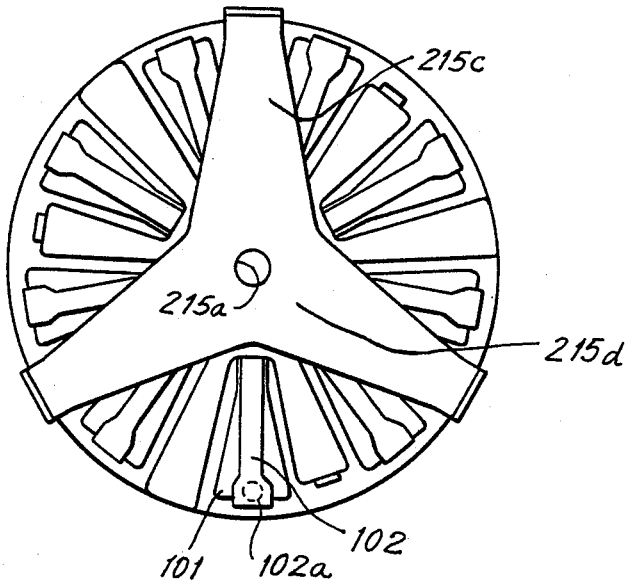
FIG. 3 is a rear elevational view illustrating the securing spring and operating end of the wire dot print head constructed and arranged in accordance with the invention as illustrated in FIG. 2.
Figure 2:
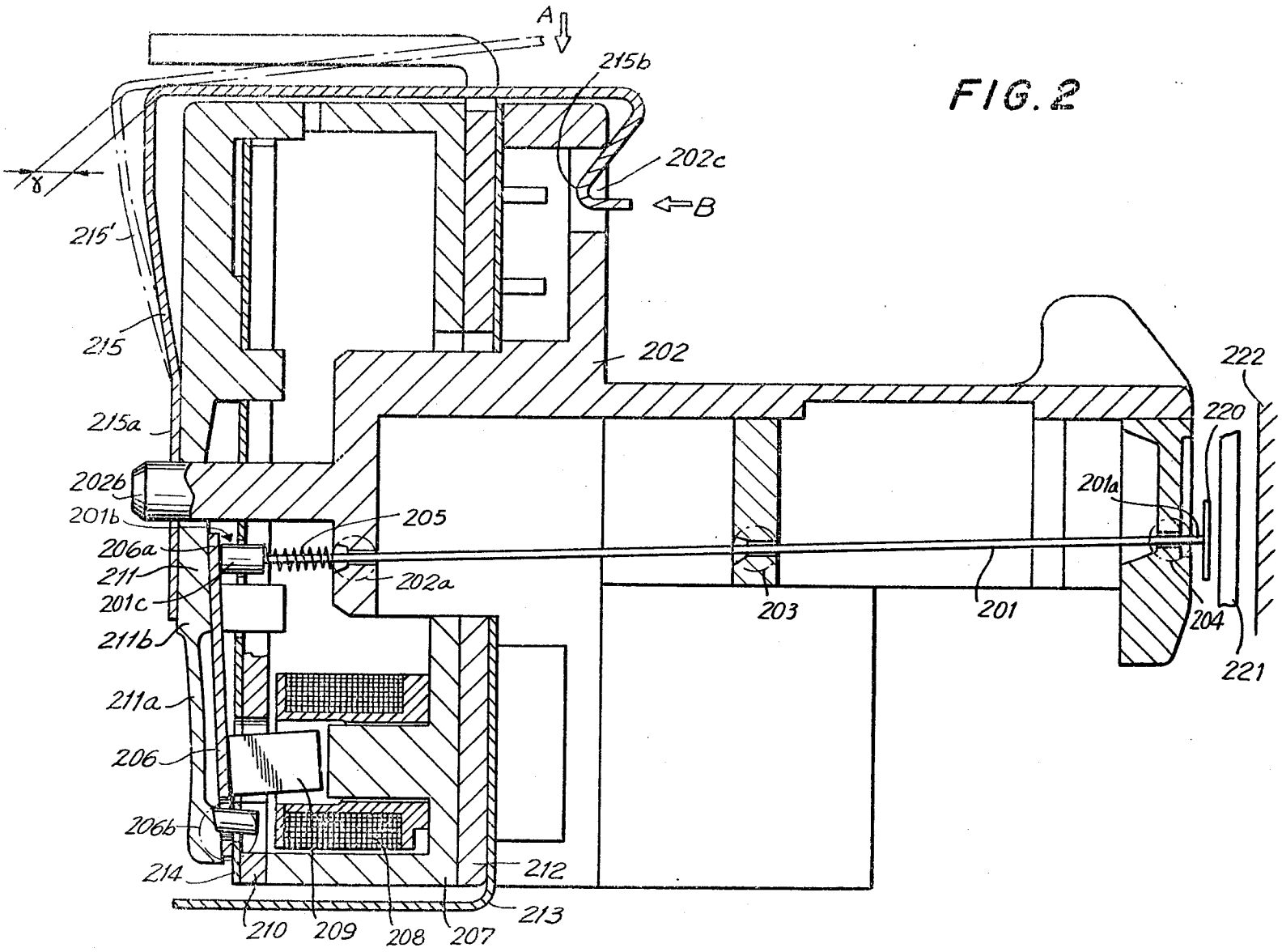
FIG. 2 is a cross-sectional view of a wire dot print head constructed and arranged in accordance with the invention.

It is clear from the foregoing description of the embodiment illustrated in FIGS. 2 and 3 that a single component, namely, securing spring 215, which can be press-formed inexpensively from a sheet of material, is sufficient for securing the various operating components of a dot head printer. This contributes greatly to facilitating assembly of the dot head and reduces the assembly cost. It is also clear from the foregoing description that securing spring 215 is a highly desirable means for securing the individual elements together.

In order to improve further the wire dot print head constructed in accordance with the invention, the fulcrum structure of the operating lever has been simplified for improving the accuracy in order to increase the efficiency of energy conversion. This aspect of the invention will be described in detail in connection with reference to FIGS. 4–6.

Figure 4:
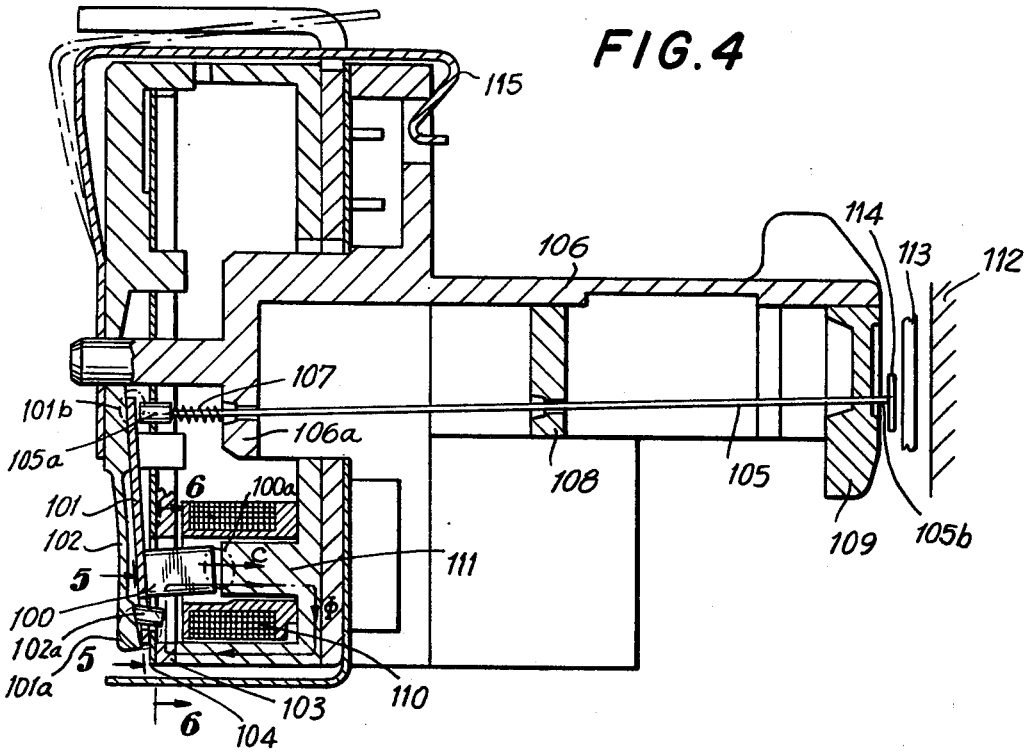
FIG. 4 is a cross-sectional view of a wire dot print head constructed and arranged in accordance with a further embodiment of the invention.

FIG. 4 illustrates a further preferred embodiment of the invention which illustrates a wire dot print head including a securing spring 115 for securing the operating members of the print head. A plunger 100 is mounted on an operating lever 101 having a fulcrum region 101*a* biased against a yoke plate 103 by a fulcrum holding spring 102 in the same manner as described in connection with the embodiment illustrated in FIG. 2. Holding spring 102 is formed at fulcrum end 102*b* with a projection 102*a* for guiding operating lever 101 when it rotates and positions operating lever 101 relative to yoke plate 103. An oil-holding sheet or spacer 104 is disposed between fulcrum portion 101*a* of operating lever 101 and yoke plate 103 for improving the durability and preventing unnecessary wear.

The opposed end of operating lever 101 to fulcrum end 101*a* is an input end 101*b* for engaging a button portion 105*a* mounted on a dot wire 105. As described in connection with the embodiment of the invention illustrated in FIG. 2, the print head described herein includes a plurality of print wires mounted in a nose 106, although only a single dot wire 105 is illustrated in the figure. Dot wire 105 is maintained in a standby position by a wire return spring 107 disposed between button portion 105*a* and a guide hole surface 106*a* formed in nose 106. Dot wire 105 is slidably supported by wire guide hole 106*a*, an intermediate wire guide 108 and an end wire guide 109 formed in nose 106. A core frame 111 for driving coil 110 is opposed to an end surface 100*a* on plunger 100.

During the printing operation, electric current is provided to driving coil 110 for an appropriate length of time by the print control circuit (not shown). Application of an electric current generates a magnetic flux shown as Φ for displacing plunger 100 from its at-rest position to its print position in the direction of an arrow C. When plunger 100 is displaced in arrow direction C, operating lever 101 is rotated, causing dot wire 105 to fly toward its print position. The print end 105*b* of dot wire 105 engages ink ribbon 114 and print paper 113 against a platen 112 for forming a printed dot on print paper 113. After dot wire 105 strikes against platen 112, it is returned to its standby position by wire return spring 107, thereby completing a print cycle. During the printing operation, successive print cycles are selectively performed for forming desired characters as the print head is displaced across print paper. An infinite array of alphabetical and numerical characters may be printed by a wire dot print head.

Figure 5:
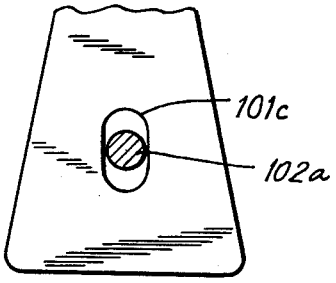
FIG. 5 is a sectional view through the projection on the fulcrum holding spring taken along the line 5—5 of FIG. 4.

The advantages obtained by constructing and arranging the print head in accordance with the invention will now be described in detail. Guiding and positioning of fulcrum portion 101*a* of operating lever 101 are accomplished by projection 102*a* on fulcrum holding spring 102, which extends through a guide hole 101*c* formed in fulcrum portion 101*a* of operating lever 101. As shown in FIG. 5, projection 102*a* on fulcrum holding spring 102 extends through guide hole 101*c*. Turning to FIG. 4, a guide hole 101*c* is shown to have been formed in an appropriate elongated configuration as illustrated in FIG. 5. This does not present any problem in positioning operating lever 101, as the angle of its rotation is relatively small. While this improvement in the construction appears to be minor, it enables guiding and positioning of fulcrum portion 101*a*. This construction in accordance with the invention is very effective for reducing the size and cost of the wire dot print head. The so-called plunger-lever-type system as shown in FIGS. 2 and 4 is already accepted as one which provides high efficiency in converting electromagnetic energy in the magnetic circuit to mechanical energy for causing dot wire 105 to fly to its print position.

Figure 6:
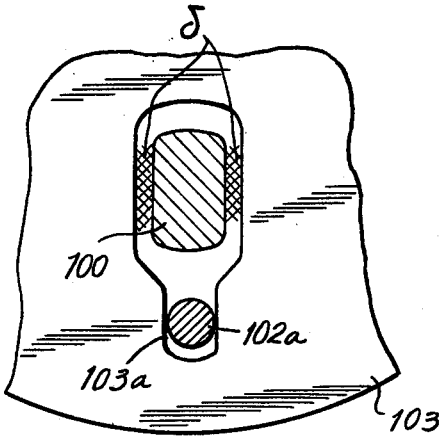
FIG. 6 is a sectional view taken through the projection on the fulcrum holding member taken along the line 6—6 of FIG. 4.

In order to take advantage of the plunger-lever-type system, it is desirable to minimize the magnetic reluctance of the magnetic flux Φ shown in FIG. 4, except in the region surrounding end portion 100*a* of plunger 100. In order to accomplish this, it is necessary to reduce the magnetic reluctance of the magnetic flux Φ by minimizing any contact between plunger 100 and yoke plate 103. This requires maintaining a minimum air gap δ as illustrated in FIG. 6, which is a sectional view taken along line 6—6 of FIG. 4. If projection 102*a* formed on fulcrum holding spring 102 extends through hole 101*c* in fulcrum portion 101*a* of operating lever 101 and is engaged with yoke plate 103 as shown in FIG. 6, the dimensional accuracy of air gap δ may be maintained and narrowed for increasing the efficiency of energy conversion. This increase in efficiency of energy conversion further permits reduction in the size of the wire dot print head.

Fulcrum holding spring 102 is generally formed from an injection molded plastic material. In such constructions, it is often difficult to form projection 102*a* as an integral part of fulcrum holding spring 102 accurately with respect to the circumference of the print head as shown in FIG. 3. In accordance with the invention, projection 102*a* extends through opening 103*a* in yoke plate 103 so that opening 103*a* provides a basis for fabricating fulcrum holding spring 102. As yoke plate 103 is formed of a metallic material, it can be easily press-formed with any desired dimensional accuracy. Thus, these arrangements overcome any difficulty in obtaining the dimensional accuracy of fulcrum holding spring 102 and permit a further reduction in cost of manufacture. It is obvious from the foregoing that a wire dot print head constructed and arranged in accordance with the invention provides excellent results in obtaining a reduction in size and cost of the print head.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wire dot print head comprising:

a print head nose having a hollow core;

a plurality of print wires slideably mounted in said core;

a plurality of selectively operable electromagnetic means disposed about said core;

operating means operatively coupled between said print wires and said electromagnetic means adapted for pivotable displacement by said electromagnetic means for selectively displacing said print wires between a first at rest position and a second print position;

holding means mounted on said operating means for supporting said operating means in position adjacent said electromagnetic means; and securing means for holding said holding means in position for maintaining the position of said operating means between said holding means and said electromagnetic means and said nose, wherein said securing means is a securing spring having a central region and outwardly extending arms for engaging said nose for securing said holding means against said operating means and said electromagnetic means.

2. The wire dot print head of claim 1, wherein said nose includes a central projection and said securing spring includes an opening for engaging said projection.

3. The wire dot print head of claim 2, wherein said arms of said securing spring extend outwardly from the center of said core over the region of said electromagnetic means and are folded over to the opposed end of said electromagnetic means formed with a clamping region, said nose formed with a receiving region for receiving said clamping region of said securing spring.

4. The wire dot print head of claim 3, wherein said securing spring includes three equidistantly spaced radially extending arms.

5. The wire dot print head of claim 4 wherein said operating means is an operating lever for each print wire, said operating lever including a metallic plunger attracted by said electromagnetic means.

6. The wire dot print head of claim 5, wherein said electromagnetic means includes a magnetic core, a coil about said core, a yoke plate at one end of said coil formed with an opening for receiving the plunger therethrough, the magnetic circuit including said magnetic core, yoke and plunger.

7. A wire dot print head comprising:

a print head nose having a hollow core;

a plurality of print wires slideably mounted in said core;

a plurality of selectively operable electromagnetic means disposed about said core;

an operating member having a fulcrum end formed with an opening operatively coupled between said print wires and said electromagnetic means adapted for pivotable displacement about said fulcrum end by said electromagnetic means for selectively displacing said print wires between a first at rest position and a second print position; and a holding member formed with a projection extending through the opening in said operating member for supporting said operating member in position adjacent said electromagnetic means and wherein said electromagnetic means includes a magnetic core, a coil about said core and a yoke plate formed with a plunger opening, said operating member formed with a magnetic plunger for attraction by said magnetic core when energized, said projection on said holding member passing through said opening in said yoke plate for maintaining said plunger a minimum distance from said yoke plate for increasing the efficiency of said printer.

8. The wire dot print head of claim 7, wherein said opening in said yoke plate is a keyhole shape having a wide region and a narrow region, said plunger passing through said wide region and said projection engaged by said narrow region.

* * * * *